358-84 SR
3/24/87 OR 4,652,915

United States Patent [19]
Heller, III

[11] Patent Number: 4,652,915
[45] **Date of Patent: * Mar. 24, 1987**

[54] METHOD FOR POLLING HEADPHONES OF A PASSIVE TV AUDIENCE METER SYSTEM

[75] Inventor: Edward P. Heller, III, Eagan, Minn.

[73] Assignee: Control Data Corporation, Minneapolis, Minn.

[ * ] Notice: The portion of the term of this patent subsequent to Dec. 2, 2003 has been disclaimed.

[21] Appl. No.: 797,341

[22] Filed: Nov. 12, 1985

[51] Int. Cl.[4] ..... H04H 9/00
[52] U.S. Cl. ..... 358/84; 455/2
[58] Field of Search ..... 179/2 AS; 358/84; 455/2; 381/25, 74; 340/825.49

[56] References Cited

U.S. PATENT DOCUMENTS

| | | | |
|---|---|---|---|
| 4,010,340 | 3/1977 | Palmaer . | |
| 4,275,385 | 6/1981 | White | 340/825.49 |
| 4,435,845 | 3/1984 | Timm et al. . | |
| 4,466,001 | 8/1984 | Moore et al. . | |
| 4,546,382 | 10/1985 | McKenna et al. | 179/2 AS |
| 4,566,030 | 1/1986 | Nickerson et al. | 358/84 |
| 4,573,072 | 2/1986 | Freeman | 358/84 X |
| 4,578,700 | 3/1986 | Roberts et al. | 358/84 |
| 4,596,041 | 6/1986 | Mack | 455/2 X |
| 4,626,904 | 12/1986 | Lurie | 358/84 |

FOREIGN PATENT DOCUMENTS

| | | | |
|---|---|---|---|
| 103438 | 3/1984 | European Pat. Off. . | |
| 2404074 | 8/1975 | Fed. Rep. of Germany | 358/84 |
| 1536414 | 12/1978 | United Kingdom | 455/2 |

*Primary Examiner*—Keith E. George
*Attorney, Agent, or Firm*—J. A. Genovese; E. P. Heller, III

[57] ABSTRACT

A method for polling headphones of a passive tv audience meter system. Tv audience members wear headphones by which they may receive the audio portion of the tv programs. The headphones are enabled to receive the audio for a short time by periodic polls transmitted by a tv audience meter. The headphones in turn acknowledge to the polls to indicate to the meter which members of the audience are watching tv. The method uses short and long period polls in conjunction with a timer whose period is shorter than the long period poll. The long period poll permits activation of headphone but also prevents adequate audio reception until the headphone acknowledges the poll. The short period poll is entered in response to the receipt of an acknowledgement and permits uninterrupted audio.

6 Claims, 7 Drawing Figures

POLL LIST EXAMPLE

| | INDEX | RESIDENT FLAG | HF ID | NEXT HF | LAST H |
|---|---|---|---|---|---|
| | 1 | R | 1 | 2 | 8 |
| | 2 | R | 2 | 3 | 1 |
| | 3 | R | 3 | 4 | 2 |
| | 4 | R | 4 | 1 | 3 |
| | | | ooo | | |
| END = 4 | 8 | 0 | 0 | 0 | 0 |
| ADD HF 6 | 1 | R | 1 | 2 | 8 |
| | 2 | R | 2 | 3 | 1 |
| | 3 | R | 3 | 4 | 2 |
| | 4 | R | 4 | 6 | 3 |
| | 5 | 0 | | | |
| END=6 | 6 | 0 | 6 | 1 | 4 |
| | 7 | 0 | 0 | 0 | 0 |
| | 8 | 0 | 0 | 0 | 0 |

Fig. 7

METHOD FOR POLLING HEADPHONES OF A PASSIVE TV AUDIENCE METER SYSTEM

BACKGROUND OF THE INVENTION

1. Field of the Invention

The invention relates generally to the field of television program ratings measurement and more particularly to methods for identifying the composition of the viewing audience watching TV programs and commercials.

2. Brief Description of the Prior Art

Conventional methods of monitoring tv audiences include meters attached to the tv set to minotor the channel tuning of the set. This has proved to be inadequate in a era where advertisers want to know precisely who is watching tv and when. Thus passive tv audience meters have been proposed. These meters include pushbuttons an audience member must push when he enters or leaves the room. Other methods include, and the following does not constitute prior art to the applicant, headphones an audience member must wear to hear the audio. These headphones are activated when a member of the audience puts them on and deactivated when he takes them off.

One method of determining the pressure of active headphones is to poll them. The receipt of an acknowledgement indicates a headphone present on the head of a viewer. Headphone audio is enabled in response to the receipt of a poll if electrical means in the headphone indicates activation of the acknowledgement mechanism. Guest headphones are included in the poll list by a guest logging information about himself into the meter and identifying the guest headphone he wishes to use. Viewing is determined to have ceased (and guests headphones removed from the poll list) when a predetermined number of poll acknowledgements are not received.

This polling scheme is not fail safe. Either the headphone response or meter polling receipt mechanisms may fail without the member of the household (whose headphone is always in the poll list and receiving polls) knowing it. Polls are received and audio enabled, but no credit is given for the member's viewing because no acknowledgements are received.

Guest headphones are not adequately handled in that if acknowledgements are not received for a time sufficient for the meter to determine that viewing has ceased, the ID of the guest headphone is taken from the poll list and the guest must reenter his information into the meter in order to reacquire audio. This can be very annoying for the guest (or household member using a guest headphone) taking a short break.

SUMMARY OF THE INVENTION

The method of the preferred embodiment comprises a polling scheme including both long and short time period polls in conjunction with a timer in the headphones whose time period is shorter than the long period poll but longer than the short period poll. The receipt of a poll immediately enables audio reception and sets the timer. If the timer times out before the receipt of the next poll, audio is disabled.

Initially when an audience member puts his headphone on (and logged in if he is a guest) the polls are in the long period. The headphone receives a poll and audio is enabled. If the headphone responds with an acknowledgement, the polling sequence goes form long to short period. A new poll is sent before the timer times out and audio is continuously enabled. However, if an acknowledgement is not sent or not properly received, the poll sequence remains in the long period and a new poll will not be sent before the timer times out and disables audio.

Additionally, the method includes preventing the polling means from exiting the short time period poll to the long time period poll for a time sufficiently long (e.g. five minutes) for the headphone wearer to take short breaks and still have his headphones reactivated by the short period poll within a very short time of his recommencing viewing. Even so, all breaks in viewing may be noted by the meter and recorded in a store independently of how polling is performed.

Finally, one version of the invention requires even household members to provide some limited form of log-in to initiate polling. The receipt of an acknowledgement is required to continue polling. This feature provides additional assurance that viewing cannot take place without the meter logging the presence of the viewer.

BRIEF DESCRIPTION OF THE DRAWINGS

FIG. 7 shows one example of addition of a entry into the poll list.

DESCRIPTION OF THE PREFERRED EMBODIMENT

Figure 1:
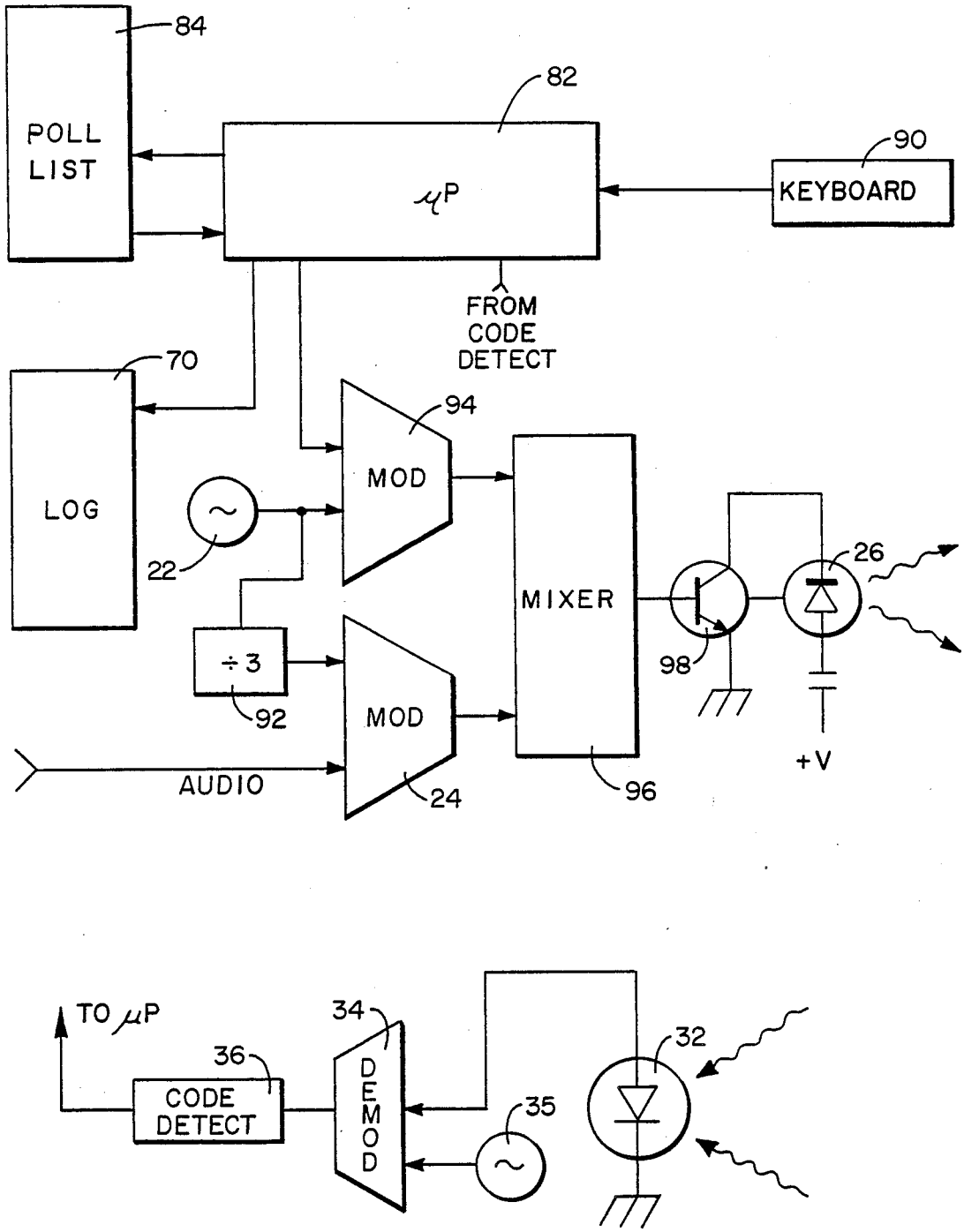
FIG. 1 is a schematic of apparatus for implementing a preferred embodiment of the polling method of the present invention.

FIG. 1 is a schematic of the preferred polling apparatus, denominated "monitor 30". This monitor is part of a audience meter apparatus (not shown) which also monitors channel tuning and reports back to a central computer, typically via telephone lines.

Monitor 30 includes a microprocessor 82 which controls the operation of the polling and interfaces with all other functional groups of the monitor. The algorithms included in the microprocessor are shown in subsequent figures, and their features will be described momentarily. The microprocessor 82 is functionally connected to a poll list 84, which contains a plurality of entries corresponding one each to the headphones in operation. Each entry contains a variety of information, among which is a headphone unique ID number by which the headphone may be polled. The microprocessor is also functionally connected to the log 70 by which it may log the start and stop times of viewing of the wearers of the various headphones. The microprocessor includes algorithms or means by which it may determine the time of day for recording in the log.

The microprocessor is further connected to a keyboard 90 by which guests may enter demographic information about themselves and identify the headphone they wish to use. (The guest headphones may also be used by household members whose headphone is malfunctioning.) Certain of the information, including the ID code of the headphone to be used, is in turn stored in the poll list as hereinafter described. In an alternative method, each householder may also be required to identify himself when he wishes to commence viewing, although the extent of information required of him may not be the same. This latter feature, if implemented, would prevent any headphone from being polled continuously unless it responds to a poll with an acknowledge. This feature would provide additional assurance that a headphone would not be used if it was not acknowledging polls.

The microprocessor is further connected to an audio transmitter (oscillator 22, divider 92, modulator 24, amplifier 98 and infrared LED 26) through modulator 94 and mixer 96 by which it may transmit the headphone unique ID to the headphones. And finally, the microprocessor is connected to acknowledgement reception circuitry comprising photodetector 32, oscillator 35, demodulator 34 and code detect circuit 36. This circuitry receives and decodes acknowledge signals transmitted by the headphones. Preferably, both the transmitting and reception diodes operate in the infrared range.

Referring to the transmitter section of FIG. 1, the audio signal from the tv set is connected to a modulator 24 which imposes the audio signal on a carrier from oscillator 22. Oscillator 22 runs, for example, at 120 khz. Divide by three circuit 92 reduces this frequency to 40 khz. The oscillator is input directly to the modulator 94 which modulates the headphone unique ID signal from microprocessor 82. Because the carrier frequency modulating the headphone ID signal is three times that modulating the audio, the two carriers are capable of separate demodulation in the headphones. The two modulated carriers are mixed in mixer 96 and are transmitted by LED 26 as driven by driver amplifier 98.

Figure 2:
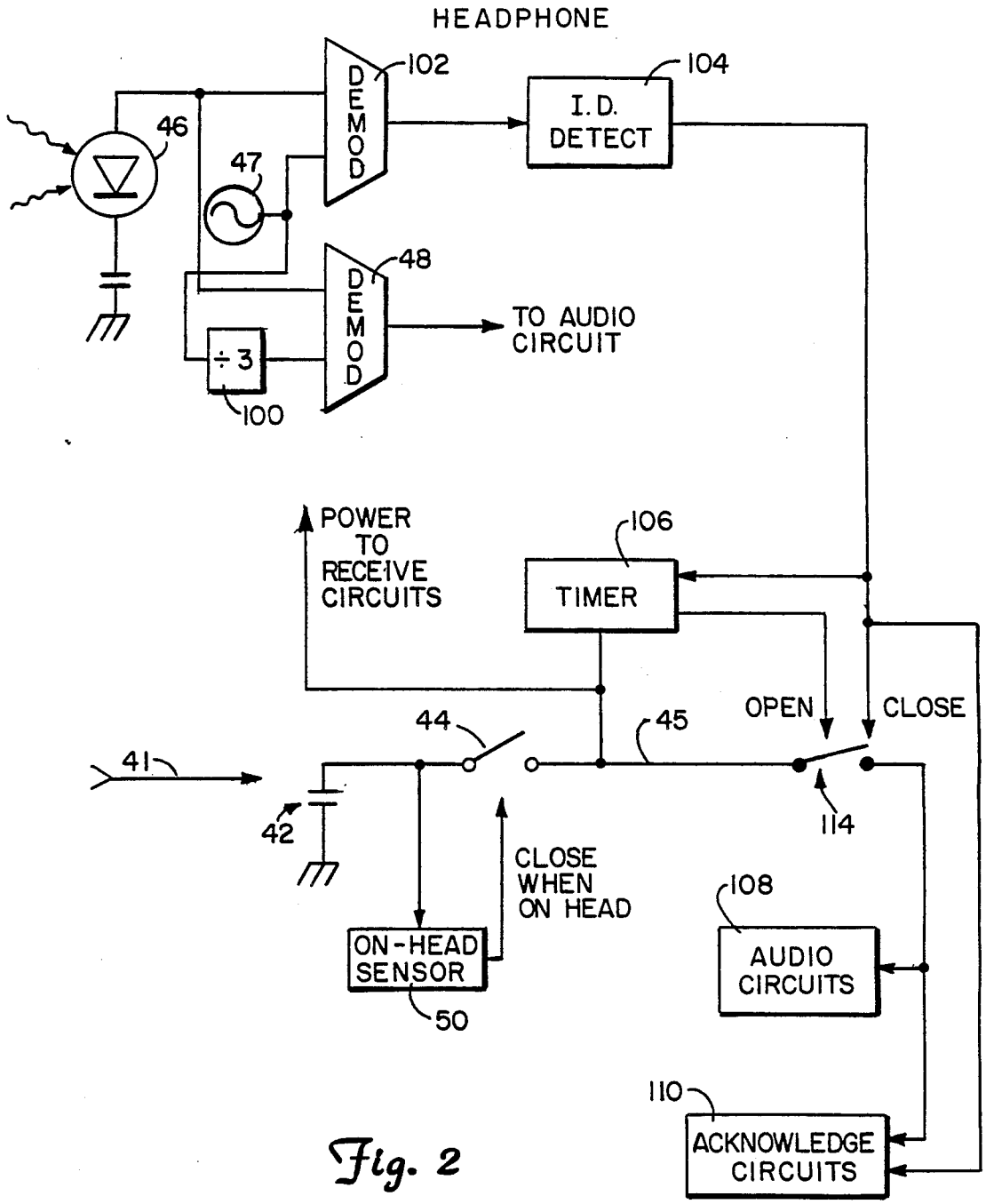
FIG. 2 is a partial schematic of a headphone according to the polling method of the present invention.

FIG. 2 shows a headphone adapted to receive transmitted audio and polling signals and respond with an acknowledgement signal. First, a rechargeable battery 42 (recharged through connector 41) is connected to on head sensor 50. When this sensor detects that someone has put the headphone on, it connects, through normally open switch 44, the battery power to the reception circuits (discussed momentarily) and to normally open switch 114. The reception circuits include photo detector diode 46 which detects the transmitted audio and Id signals. The diode is input to demodulator 48 which demodulates the audio for subsequent conventional stereo decoding, amplification and aural transduction in audio circuits 108. Oscillator 47 is input to divider 100 and into demodulator 48. This demodulator demodulates the audio from the low frequency carrier. The oscillator is also directly input to demodulator 102. This demodulator demodulates the headphone unique ID signal (poll) from the high frequency carrier. The output of the demodulator is input to an ID detect circuit 104 which responds only to the predetermined ID signal of the headphone (each headphone in a household has a different ID to which it responds). The detect circuit signals switch 114 to close, connecting battery power to the audio and acknowledge circuits 108 and 110 respectively, and also starts timer 106. When timer 106 times out, it opens switch 114 to disconnect power from the audio and acknowledge circuits. Switch 114 remains closed unless opened by timer 106 or power is disconnected in response to the wearer taking his headphone off and the on head sensor opening switch 44. The signal from ID detect circuit 104 is also input to the acknowledge circuit 110. Each time ID detect recognizes receipt of its ID in a poll, it signals the acknowledge circuits to transmit an acknowledge signal. The acknowledge circuitry is similar to the transmitting circuitry with the frequency of the carrier being different from that of the audio.

Audio is heard by the headphone wearer only when he has the headphone on and a poll bearing that headphone's unique ID code is received. Thereafter, the audio will be disabled if the timer 106 times out before the next poll bearing the ID signal is received. According to the algorithm of the preferred method, such as a poll will not be sent before the timer times out unless an acknowledgement is received by the monitor 30.

Figure 3:
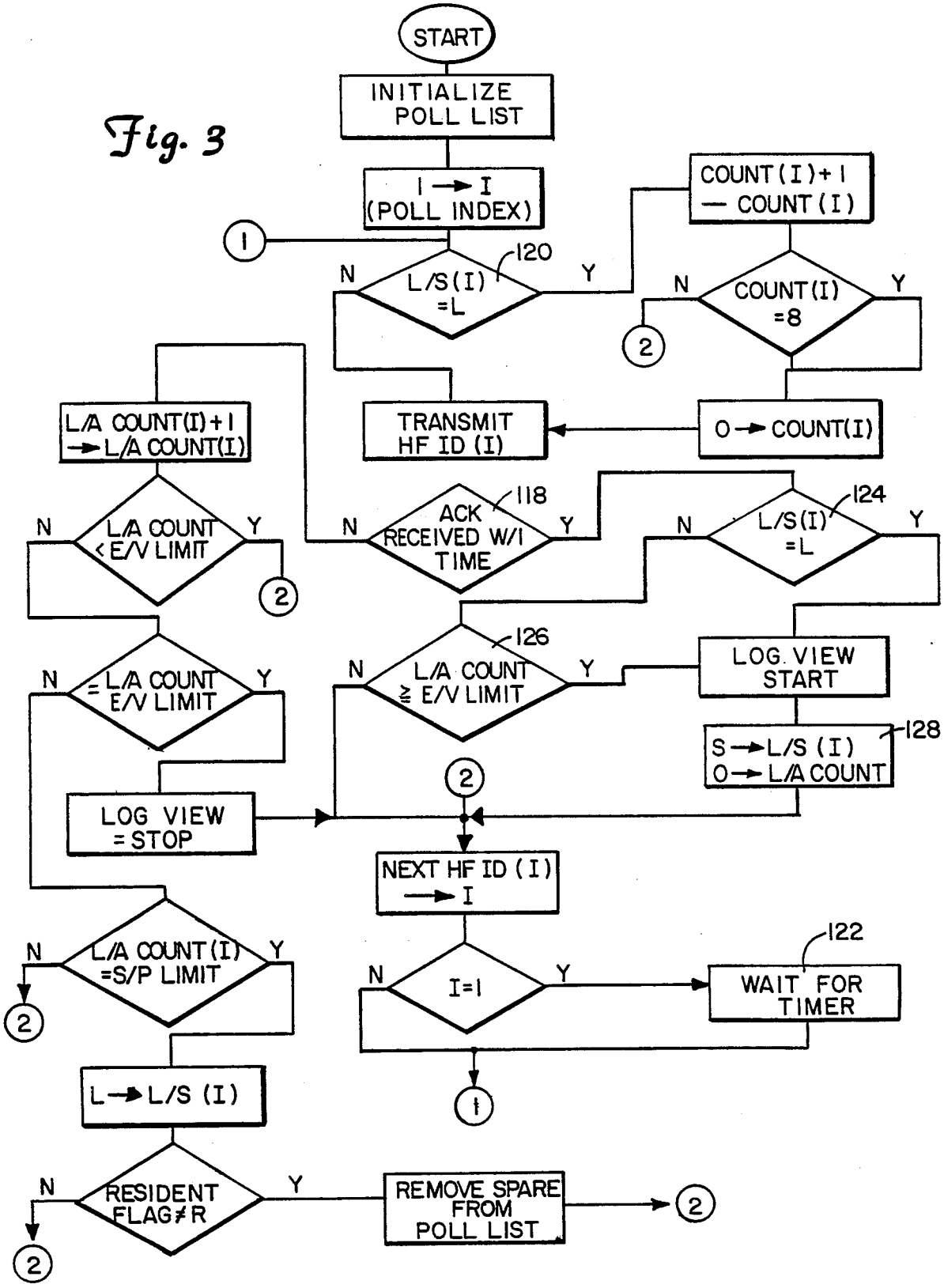
FIG. 3 is a flow diagram of the microprocessor algorithm implementing the preferred polling method.

FIG. 3 shows a logical flow chart of the preferred polling method. START is entered on power up of the monitor. The first step is to intialize the polling list 84 by clearing out residual guest and spare headphone entries, if any, setting all resident headphone entry long/short flags ("L/S flags") to L (long sequence poll) and setting the end of list pointer END to point to the last headphone entry in the list. Those headphone entries belonging to the residents of the home are denoted by a RESIDENT FLAG in the entry. See FIG. 4. The entries are placed in the list by the ratings serviceman when he first installs the monitor in a panelist's home or may be retrieved by the meter from the central computer (remote programming capability). Typically there will be an entry for each adult male, adult female, and child in the household. The type of entry is described in the demographics field of the entry. See FIG. 4.

Next the list index pointer "I" in initialized with the number 1. This points to the first entry in the list, which in most households is the adult male.

Next the microprocessor examines the L/S flag of the entry indexed by "I" (which is entry 1 on the first pass) to see if it is L or S, L indicating a long sequence poll, S indicating a short sequence poll. Initially, all resident headphones are in the long sequence, and the path to the right is taken.

A long sequence poll is eight times longer than a short sequence poll in this embodiment. If the short sequence poll period is four seconds, the long sequence poll period is 32 seconds. The time difference in the long and short poll sequences is controlled by an L/S delay count. The the L/S delay count, initially zero for resident headphones (but non zero for guest headphones, see infra), is incremented by 1. If the count is not yet eight, the path to the left is taken which leads to entry point (2) on the flow chart. Here the next headphone number is stored in index "I" and the next headphone entry is processed. If the count is eight, zero is stored in the L/S delay count field of the entry and the algorithm proceeds to transmit the headphone ID of the entry ("HF ID(I)") to the headphones. Thus, in the long sequence poll, a poll is not actually sent until eight passes through this delay count subroutine. If a pass is made every four seconds for example (the period of a pass is controlled by a timer, see box 122 on the flow chart), thirty-two seconds will elapse between issuance of polls.

Next, the microprocessor waits a predetermined time for the reception of an ACK (acknowledge) from the headphone addressed. This will occur only if the headphone is present on the head of a viewer and he has his head pointed in the direction of the tv set.

When the headphone transmits its first ACK, The L/S flag is "L", the long sequence, and the microprocessor takes the path to the right of decision block 118. Here, the microprocessor logs the viewer's viewing start time, his headphone ID number and his demographics in the log 70 and sets the L/S flag to "S", so that the short poll sequence path from decision block 120 is taken the next time the poll list is processed.

Both paths from decision block 124 eventually meet at block two (2) where the index is updated to the next headphone number. If the next headphone number is not number one, the algorithm continues to decision block 120, denoted on the flow chart as entry point (1) where the next entry in the poll list is processed in the same manner as the first. If, however, the next headphone number is number one, then all headphones in the list have been processed and the microprocessor waits at block 122 until a timer or clock signal times out (e.g. in four 4 seconds) until proceeding to process the list a next time. In this manner, polling is periodic, the period depending upon the time base of the timer (which is implemented in the microprocessor).

Assuming one of the headphones has previously transmitted an ACK indicating that it is now on the head of a viewer, the next time this headphone is processed, the L/S flag is "S" and the short poll sequence path to the left of decision block 120 will be taken. This leads directly to the immediate issuance of a poll and not to the previously described delay subroutine. The poll for active headphone is issued every pass through the polling list (e.g. every 4 seconds) while the poll for inactive (or non responding) headphones is issued only once every eight times through the list (e.g. every 32 seconds).

Assuming that a poll is transmitted but an acknowledge is not received. The path to the left of decision block 118 is taken. If the L/S flag is "L", then the headphone, initially inactive, remains inactive and the algorithm essentially proceeds to the next headphone in the list. However, if the L/S flag is "S", the headphone was at one time active and some sort of interruption has taken place: The viewer may have turned his head; he may have left the room for a short break; or he may have discontinued viewing entirely. (This latter fact may be confirmed if the tv set is turned off by the viewer.) In order not to peremptorily conclude that viewing has permanently ceased, a count called Last Ack or L/A Count for short, is incremented in the entry. (Note that when the start time was logged, this count was reset. See block 128). If this count has not reached a limit ("E/V limit") set by the ratings service indicative of a conclusion that viewing has indeed terminated, the algorithm does nothing further with this entry and proceeds on to poll the next headphone. Thus polling proceeds as normal until a time limit as determined by "E/V limit" has been reached. The time limit may be ten to twenty seconds if short breaks are to be allowed without it being concluded that viewing has stopped.

If however the "E/V limit" is reached, viewing has ceased, even even if temporarily. At this point the microprocessor logs the viewing stop time for this headphone in the log 70 and proceeds on to process the next headphone in the list. However, even though viewing stop time has been logged, the headphone entry remains in the poll list in the short sequence mode so that if the viewer returns to viewing within a reasonably short time, he will quickly receive a poll to activate his headphone so that he may resume his acquisition of sound in a relatively short period of time. At that time, his headphone will respond with an ACK signal and the algorithm will find itself at decision block 126. Here it will be determined that the "E/V limit" had previously been exceeded and the viewer's viewing stop time recorded in the log. As viewing has recommenced, the path to the right is taken and the viewing start time is recorded in the log. Thereafter, in block 128, the L/A Count is reset to zero so that short absences of an ACK will not result in an immediate determination that viewing has ceased.

After a headphone has been "logged off" (the viewer has interrupted watching tv), the L/A count continues to increment until reaching a limit ("S/P limit") indicative of permanent cessation of viewing. If this limit is reached, the microprocessor resets the L/S flag to "L" so that subsequent polls to the headphone, if any because guest headphones are removed from the list, are in the long poll sequence. If this entry is for a guest or a spare headphone, as indicated by the RESIDENT FLAG of the entry, then the entry is deleted from the list.

A primary reason for having long and short polling periods is to assure that the timer 106 in the headphone times out and disables further receipt of audio unless the headphone responds with an acknowledge. This prevents headphones from receiving and transducing the audio continuously without their being credit given for the viewing.

Figure 4:
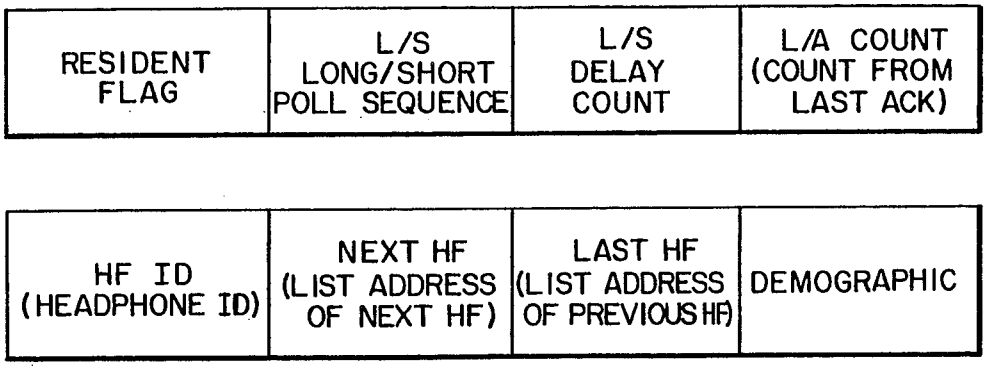
FIG. 4 shows the fields contained within an entry in a poll list according to the preferred polling method.

FIG. 4 shows the fields of a poll list entry. The first field is the RESIDENT flag; the second is the L/S flag, the next is the L/S delay count; the next is the Last Ack count ("L/A count"), and the next is the headphone ID ("HF ID"), and heretofore discussed. The final two fields relate to list processing. The first is the next headphone number, which, in the list scheme employed, is also the list index of the next headphone. This is because the headphone ID number corresponds to its index in the list. The second of the two is the last headphone number denoting the list index of the previous headphone in the list. These two fields make the processing of each possible headphone entry unnecessary. The entries are chained together by these two field and only those entries corresponding to active or resident headphones are examined. The method of chaining will become clear with reference to the add and remove entry algorithms which will be discussed in relation to FIGS. 5, 6 and 7.

The last field of the entry is the demographic information associated with the viewer wearing the headphone.

Figure 5:
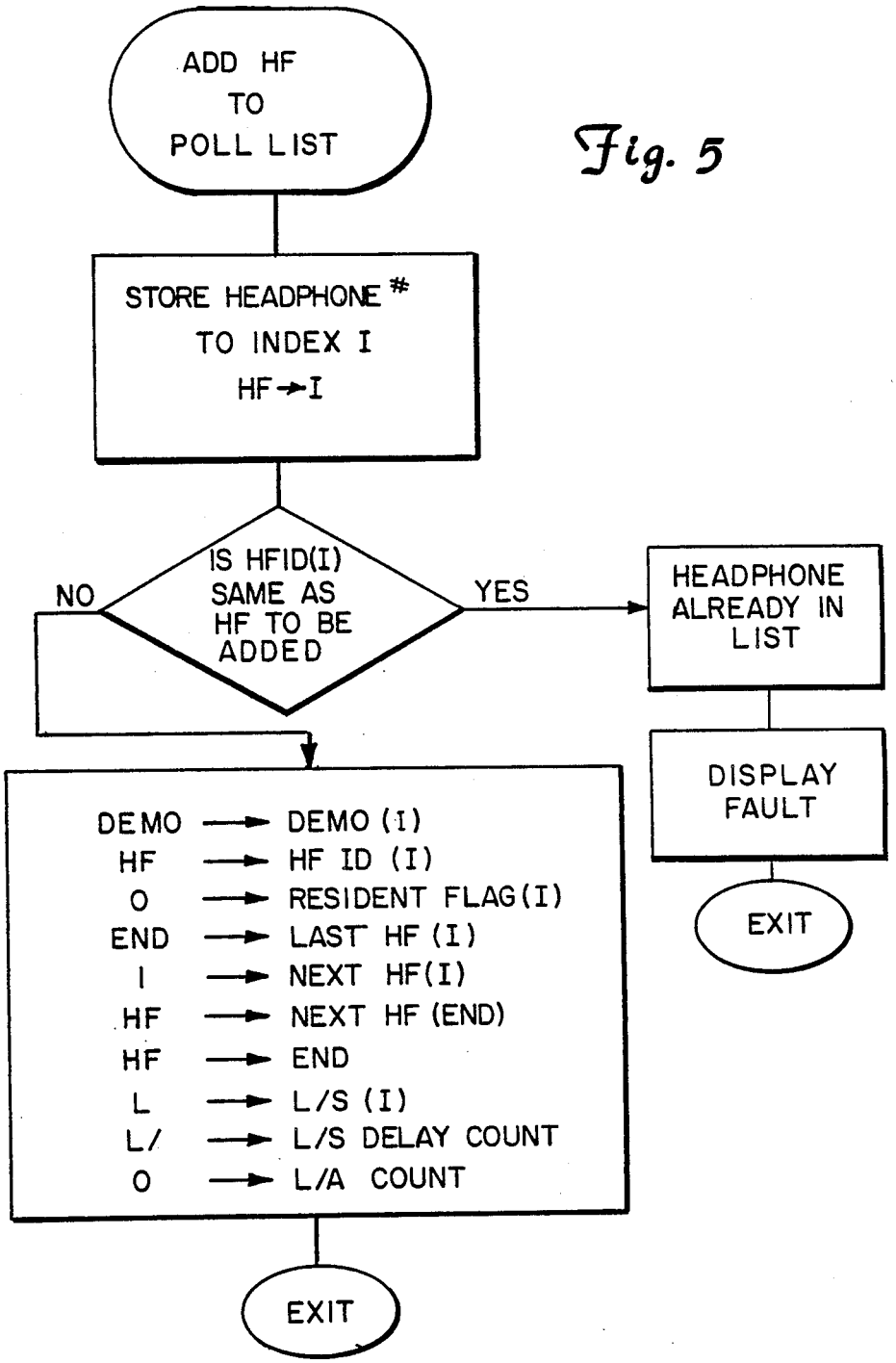
FIG. 5 shows the algorithm for adding an entry into the poll list.

FIG. 5 shows the add entry algorithm. This is used when a viewer uses the keyboard 90 to "log in" a guest or spare headphone. The microprocessor then stores the headphone number entered by the "guest" into index "I". Next, the headphone number of the entry indexed by this number is interrogated. If it is the same as that just entered, then there is already and entry in the list for this headphone and a fault display indicative of this in signalled (a red light on the monitor) to the guest or resident. If it is not the same (for it normally will be zero, indicative of reset), then the ID and demographic information are stored in their corresponding fields. Next, the RESIDENT FLAG is set to zero, indicating that this entry is for a guest or spare headphone. The end of list pointer END is updated to point to this entry and the previous end of list pointer is stored in the Last HF field of the entry (the chain backwards). As a new entry is always the last entry in the chain, the next entry in the chain will be headphone number one. Thus, number 1 is stored in the Next HF field (the chain forwards). The L/S flag is set to "L" (long sequence poll), and the count fields, L/S delay and Last Ack ("L/A count") are initialized. Preferably the initial count stored into the L/S delay count field in a number greater than zero (4 in the preferred embodiment) so that the first poll issued to the guest or spare headphone would occur approximately 16 seconds after the manual headphone "log on" is complete to allow the guest time to put on his headphones before the first poll is sent, but not so long for the delay to the receipt of the first poll and the enablement of audio reception is annoying. If all is normal in the headphone, it will respond with an ACK permitting the entry into the short sequence poll. If, however, the headphone malfunctions, the timer, initially reset by the first poll, will time out disabling the audio reception of the headphones.

Figure 6:
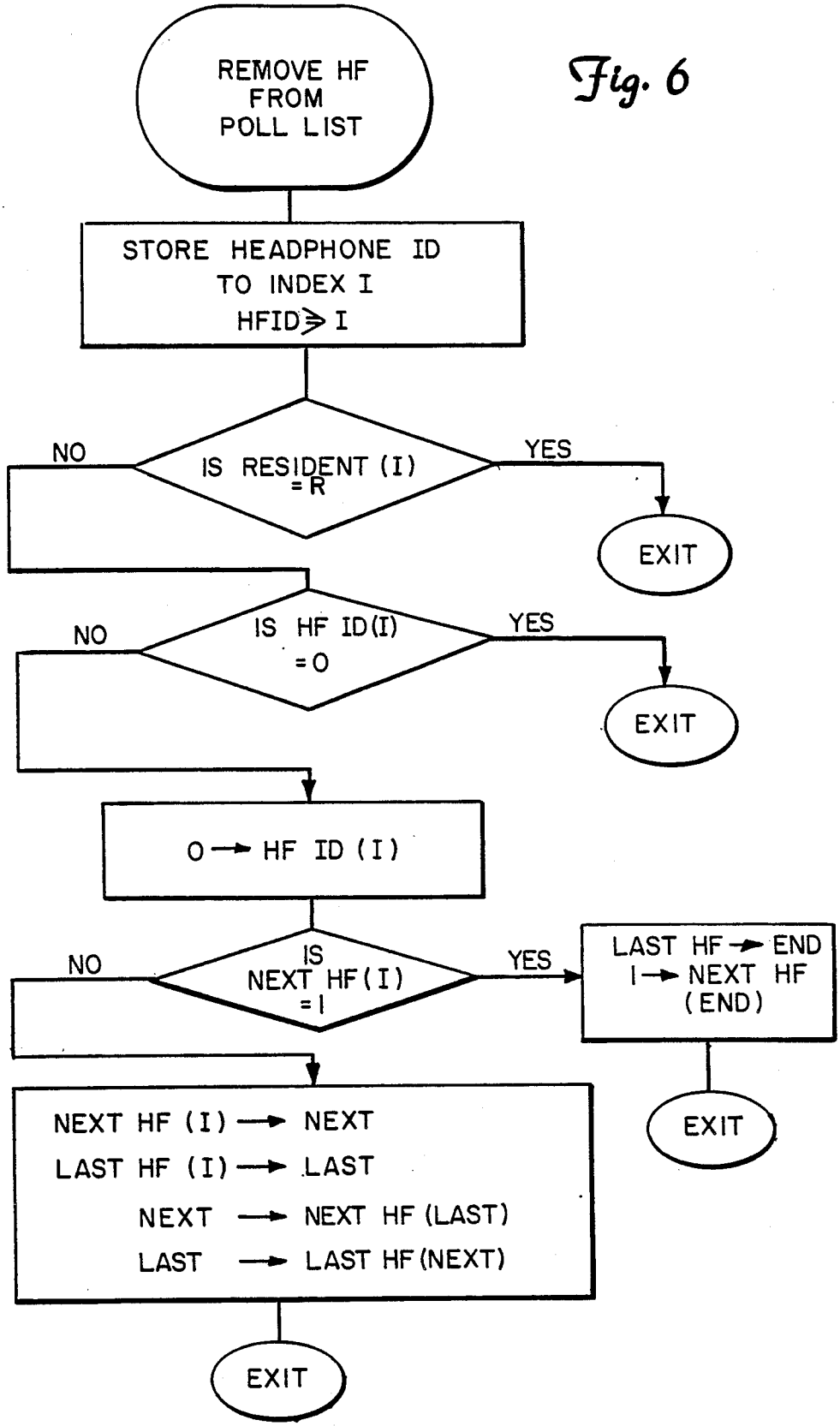
FIG. 6 shows the algorithm for deleting an entry from the poll list.

FIG. 6 shows the routine for removal of an headphone entry from the list, which occurs some time after a "guest" has ceased watching tv. See FIG. 3. The ID of the headphone to be removed is first stored to index "I" (if not already there) and the RESIDENT FLAG interrogated. If this is a resident headphone, the entry is not deleted and the routine exits. If the headphone ID number of the entry is zero, then there is no entry for this headphone in the list and the routine likewise exits. Otherwise, a valid guest entry exists and it is deleted by the following steps. The HF ID field is zeroed. If the Next HF number is 1 (which it would be if this is the last entry in the chain) then the Last HF number is stored in the end of list marker END and 1 stored in the Next HF field of the entry indexed by END. This makes the previous entry in the list the last entry and make that "previous" entry's "Next HF" field point to the top of the list, headphone number 1.

If the entry to be deleted is not the last headphone in the list, then the procedure is a little more complex. The Next HF number is stored in a index called Next and the Last HF number is stored in an index called Last. Then Next is stored in the Next HF field as indexed by Last, while Last is store in the Last HF field as indexed by Next. This deletes an entry from the middle of a chain by linking the previous entry to the next entry. When this is done, and the HF ID number of the deleted entry is zeroed.

An example of a poll list addition is shown in FIG. 7, showing before and after field contents of the relevant fields. Initially there are four resident headphones. Note that the headphone ID number is the same as the index. Each Next HF field has the headphone or index number of the next headphone in it, while the Last HF filed contains the number of the previous headphone. The end of list marker END points to 4, the last entry in the list.

When headphone 6 is added to the list, it is added at index 6. The next headphone field of entry 4 now has the number 6 in it and the last headphone field of entry 6 has the number 4 in it. To complete the chain, the next headphone field of entry 6 has the number 1 in it. END points to entry 6.

Deletion of entry number 6 restores the list to its previous condition.

I claim:

1. A method of polling headphones having means for receiving a headphone unique identification ("ID") poll, means responsive to the receipt of a headphone unique ID poll for enabling a timer and headphone audio and for transmitting an acknowledge signal, and means responsive to the timer for disabling the headphone audio when it times out comprising:

polling the headphones of an audience metering system with a headphone unique ID signal having a long time period between polls; the headphone polled by the headphone unique ID code responding to the receipt of the poll by enabling audio, transmitting an acknowledge signal, and terminating audio after a predetermined period of time shorter than said long time period unless another poll having the unique ID code of this headphone is received;

and in response to the receipt of an acknowledge signal from the headphone polled, continuing polling this particular headphone with a short time period between polls, the short time period being less than the predetermined time of the headphone to disable audio.

2. The method of claim 1 further including logging listening start time in response to receipt of the first acknowledge from a headphone and logging listening stop time after a predetermined number (E/V) of failures to acknowledge polls.

3. The method of claim 2 further including maintaining the polling of a headphone in the short sequence until a predetermined number (S/P) of failures to acknowledge have occurred, where S/P is greater than E/V.

4. A method of polling headphones having means for receiving a headphone unique identification ("ID") poll, means responsive to the receipt of an headphone unique ID poll for enabling a timer and headphone audio and for transmitting an acknowledge signal, said means for transmitting an acknowledge signal further responsive to on-head sensor means for determining when the headphones are on a wearer's head, and means responsive to the timer for disabling the headphone audio when it times out including permitting a predetermined number of failures of a headphone to respond to a poll addressed to it after having been responding to them for a period of time before concluding that the non-responsive headphone is no longer on a wearer's head.

5. A method of polling headphones having means for receiving a headphone unique identification ("ID") poll, means responsive to the receipt of an headphone unique ID poll for enabling a timer and headphone audio and for transmitting an acknowledge signal, said means for transmitting an acknowledge signal further responsive to on-head sensor means for determining when the headphones are on a wearer's head, and means responsive to the timer for disabling the headphone audio when it times out including continuing to poll a headphone for only a predetermined time after it has been concluded that that headphone is are no longer on a wearer's head.

6. A method of polling headphones having means for receiving a headphone unique identification ("ID") poll, means responsive to the receipt of an headphone unique ID poll for enabling a timer and headphone audio and for transmitting an acknowledge signal, said means for transmitting an acknowledge signal further responsive to on-head sensor means for determining when the headphones are on a wearer's head, and means responsive to the timer for disabling the headphone audio when it times out including maintaining polling to a particular headphone for a predetermined time using a short polling period after it has been concluded that the particular headphone is no longer on a wearer's head.

* * * * *